US007854261B2

(12) United States Patent
Woie et al.

(10) Patent No.: US 7,854,261 B2
(45) Date of Patent: Dec. 21, 2010

(54) METHOD AND AN APPARATUS FOR SEPARATION AND INJECTION OF WATER FROM A WATER- AND HYDROCARBON-CONTAINING OUTFLOW DOWN IN A PRODUCTION WELL

(75) Inventors: Rune Woie, Hafrsfjord (NO); Thor Martin Hegre, Hafrsfjord (NO)

(73) Assignee: Shore-Tec Consult AS (NO)

( * ) Notice: Subject to any disclaimer, the term of this patent is extended or adjusted under 35 U.S.C. 154(b) by 323 days.

(21) Appl. No.: 12/097,034

(22) PCT Filed: Dec. 4, 2006

(86) PCT No.: PCT/NO2006/000456

§ 371 (c)(1),
(2), (4) Date: Sep. 19, 2008

(87) PCT Pub. No.: WO2007/069904

PCT Pub. Date: Jun. 21, 2007

(65) Prior Publication Data

US 2009/0014171 A1 Jan. 15, 2009

(30) Foreign Application Priority Data

Dec. 12, 2005 (NO) ..... 20055868

(51) Int. Cl.
*E21B 43/40* (2006.01)

(52) U.S. Cl. ..... 166/265; 166/266; 166/306; 166/370

(58) Field of Classification Search ..... 166/265, 166/105, 105.5, 227, 266, 228, 306, 370
See application file for complete search history.

(56) References Cited

U.S. PATENT DOCUMENTS 4,241,787 A 12/1980 Price (Continued)

FOREIGN PATENT DOCUMENTS

WO 94/13930 A1 6/1994

(Continued)

OTHER PUBLICATIONS

International Search Report for parent application PCT/NO2006/000456, having a mailing date of Mar. 19, 2007.

*Primary Examiner*—Daniel P Stephenson
(74) *Attorney, Agent, or Firm*—Andrus, Sceales, Starke & Sawall, LLP

(57) ABSTRACT

A method and apparatus of separating, in a production well, water from a water- and hydrocarbon-containing production flow emanating from at least one surrounding production formation; and also of injecting, in the production well, a resulting water-containing liquid into at least one surrounding disposal formation, whilst a resulting hydrocarbon-containing liquid is produced out of the production well. The water-containing liquid is separated from the production flow by using at least one water separation device being exposed to a pressure difference ($P_1$-$P_2$) that sucks water from the production flow and through the water separation device. Said water-containing liquid is thus provided. The water separation device may, for example, comprise at least one hydrophilic and water-permeable material. The pressure difference ($P_1$-$P_2$) may be provided through suitable adjustment of a gas pressure ($P_3$) in a first gas column at a downstream side of the water separation device. The gas within the gas column may be supplied from a gas source at the surface, a gas source in a subsurface formation and/or gas being separated from the well flow.

20 Claims, 7 Drawing Sheets

U.S. PATENT DOCUMENTS

| | | | | | |
|---|---|---|---|---|---|
| 4,296,810 | A | * | 10/1981 | Price | 166/265 |
| 4,805,697 | A | * | 2/1989 | Fouillout et al. | 166/265 |
| 5,296,153 | A | | 3/1994 | Peachey | |
| 5,913,363 | A | | 6/1999 | Paplinski | |
| 6,092,599 | A | | 7/2000 | Berry et al. | |
| 6,691,781 | B2 | | 2/2004 | Grant et al. | |
| 6,755,251 | B2 | | 6/2004 | Thomas et al. | |
| 2002/0189807 | A1 | | 12/2002 | Emanuele et al. | |
| 2003/0047310 | A1 | | 3/2003 | Thomas et al. | |
| 2003/0080061 | A1 | * | 5/2003 | Underdown et al. | 210/650 |
| 2006/0037746 | A1 | * | 2/2006 | Wright et al. | 166/265 |

FOREIGN PATENT DOCUMENTS

| | | | |
|---|---|---|---|
| WO | 01/65064 | A1 | 9/2001 |

* cited by examiner

METHOD AND AN APPARATUS FOR SEPARATION AND INJECTION OF WATER FROM A WATER- AND HYDROCARBON-CONTAINING OUTFLOW DOWN IN A PRODUCTION WELL

CROSS-REFERENCE TO RELATED APPLICATIONS

This application is the U.S. national stage application of International Application No. PCT/NO2006/000456, filed Dec. 4, 2006, which International application was published on Jun. 21, 2007, as International Publication No. WO 2007/069904, A 1, in the English language, which application is incorporated herein by reference. The International application claims priority of Norwegian Patent Application No. 20055868, filed Dec. 12, 2005, which application is incorporated herein by reference.

FIELD OF THE INVENTION

This invention relates to hydrocarbon production from a subsurface reservoir via a production well. More particularly, the invention involves a method and an apparatus for separation and injection of water from a water-and hydrocarbon-containing production flow from the reservoir. By means of the invention, a water-containing liquid separated from the production flow may be injected directly into a subsurface disposal formation via the production well, and without initially having to bring the water-containing liquid up to the surface. Hydrocarbons remaining in the production flow after the water separation, i.e. a hydrocarbon-containing liquid, are produced out of the production well as a hydrocarbon-enhanced outflow.

BACKGROUND OF THE INVENTION

In addition to desirable hydrocarbons in the form of oil and/or gas, a hydrocarbon well oftentimes produces undesirable water. After having been produced for some time, such wells frequently produce large amounts of water to the surface along with hydrocarbons. This is particularly applicable at later stages of the production lifetime of such a well, the stages at which water may amount to as much as 98% by volume of the outflow, and at which the water may include both formation water and potential injection water. Handling of produced water involves substantial costs associated with, among other things, lifting, separation and disposal thereof.

In a well outflow containing such water, the water will occupy a volume that otherwise could have been filled with desirable hydrocarbons. Thereby the hydrocarbon outflow rate from the production well will be reduced relative to a corresponding well outflow containing mainly hydrocarbons. Insofar as the specific gravity of water normally is larger than that of hydrocarbons, such water will also increase the specific gravity of well outflow relative to that of a mainly hydrocarbon-containing outflow. In general, a water-containing well outflow will therefore require more pressure energy than that of hydrocarbon-containing outflow to be lifted to the surface, which implies that less pressure energy remains to drive produced fluids out of the well. Thereby both the combined outflow rate and the hydrocarbon outflow rate from the well are reduced, and large amounts of water in the outflow eventually may cause the production flow to stop completely, thereby making it difficult to start the well after a production shut-down. A water-containing production flow also increases the probability of oil/water emulsions forming in the outflow. Oftentimes, such emulsions are problematic during separation in surface-based separation equipment in terms of reducing, among other things, the separation efficiency of the separation equipment. Moreover, a large content of water in the outflow may require the production rate to be reduced due to capacity limitations of such surface-based separation equipment.

Furthermore, produced water cause some environmental problems and challenges. In general, water separated from hydrocarbons at the surface must be purified before being disposed or dumped at the surface. This type of water purification normally involves undesirable use of chemicals as well as associated costs and environmental problems.

In light of the aforementioned problems and challenges associated with water undesirably produced to the surface, it would be of great significance if produced water could be separated and removed down in the production well, and without having to be brought to the surface for further processing. Such a technical solution would provide great environmental, process technological and economic advantages.

PRIOR ART

According to prior art in this area, various methods and devices are disclosed, tested and potentially used in order to separate water from hydrocarbons in a production well.

Both U.S. Pat. No. 5,296,153 and WO 94/13930 describe separation of water from a water- and oil-containing production flow down in a production well by means of a cyclone separator and pumps belonging thereto. Subsequent to the cyclone separation, a separate oil flow is directed out of the well whilst a separate water flow is introduced into a disposal formation near the well. Both U.S. Pat. No. 5,296,153 and WO 94/13930 employ a different principle of separation than that used in the present invention.

U.S. Pat. No. 6,092,599 relates to a downhole oil and water separation system based on gravity separation. The separation system involves a casing interval for temporary storage and separation of a water- and oil-containing production flow. In this interval, the production flow is gravity-separated into an underlying water phase and an overlying oil phase. Each liquid phase is then pumped to the surface by means of a pump each. It is obvious that this separation system may only be used for this type of separation in context of very small production rates. Also U.S. Pat. No. 6,092,599 employs a different principle of separation than that used in the present invention.

U.S. Pat. No. 6,691,781 relates to downhole separation of a water- and hydrocarbon-containing production flow originating from a subsurface formation. The gas phase and liquid phase of the production flow is separated by means of horizontal gravity-separation in a horizontal section of the associated production well. At least a portion of the separated gas is re-injected into the same subsurface formation. Prior to injection, the gas is compressed by means of a downhole compressor driven by a downhole turbine, which is supplied with hydraulic power from the surface. If desirable, water may also be separated from said liquid phase and be injected together with the gas into the formation. A different principle of separation than that used in the present invention is also used here.

U.S. Pat. No. 4,241,787 relates to downhole separation of a water- and oil-containing production flow, wherein separated water is injected into a disposal formation, whilst remaining oil is produced to the surface. In this connection, the separated water phase and oil phase are pumped separately to a target area each by means of a pump each. Preferably, these two pumps are arranged in a joint pump assembly driven by a joint motor, which is provided with driving power from the surface. U.S. Pat. No. 4.241.787 differs from the aforementioned prior art in that it employs, among other things, one or more separator elements that comprise semi-permeable membranes in order to separate water from the production flow. In this connection, the expression "semi-permeable" indicates that such a membrane is comprised of a material being permeable to water, but which is relatively impermeable to oil. As such the membrane material is water wetting and extremely hydrophilic whilst simultaneously being oil-repellent. Water separation is carried out by means of a water-sucking pressure difference across the membrane(s). Preferably, the semi-permeable membranes are arranged in a joint separator assembly connected to said pump assembly. U.S. Pat. No. 4,241,787 also mentions that a preferred membrane material is a hydrophilic sulfonate polymer bearing sulfonate groups, i.e. $SO_3^-$, on the material surface and in the pores of the material. Such a sulfonate polymer membrane may be formed as a thin film on both sides of a tube wall in a styrene-based polymer tube through which the water- and oil-containing production flow is directed. For example, said separator assembly may comprise a cylinder with an array of several elongated, parallel and thin separator tubes formed from such a membrane material, and which constitute separator elements. A water-and hydrocarbon-containing production flow is directed through the tubes, and water is separated from the production flow via the walls of the tubes and then is directed therefrom separately.

US2002/0189807 relates to a method and a system of downhole separation of oil and water by utilizing a separator apparatus and a hydrostatic pressure head of separated water for disposal thereof in a subsurface disposal formation. Similar to U.S. Pat. No. 4,241,787,, this separator apparatus preferably comprises a hydrophilic membrane. Preferably, the membrane is composed of modified polyacrylonitrile. It may also comprise modified polyethersulfones, alfa-alumina and/or zirconium. In order to dispose the water, a pump may possibly be utilized in addition to the pressure head of the separated water.

U.S. Pat. No. 6,755,251 relates to a method and a system of downhole separation of gas, wherein also a membrane material for separating components from a hydrocarbon-containing well flow is utilized. Preferably, the membrane material is of a tubular shape and may, for example, be embodied in or as a well pipe. It may also be embodied as an array of several elongated, parallel and thin separator tubes in a well pipe, as disclosed in U.S. Pat. No. 4,241,787. Typical membrane materials include inorganic materials, organic polymers, or composites of inorganic materials and organic polymers. Organic polymers, however, are less resistant to high temperature-and pressure conditions typically prevailing in a well. Preferably, inorganic membrane materials are therefore used in this connection. Known microporous inorganic membranes include porous glass, ceramic sinters, and metal sinters.

DISADVANTAGES OF THE PRIOR ART

The aforementioned downhole separator devices are of a relatively complex construction and/or involve many movable parts. Normally, such devices are comprehensive and/or complicated to drive, inspect and maintain. This especially applies to pumps and other driving devices that constitute required components in the aforementioned separator devices.

Moreover, horizontal gravity-separation according to U.S. Pat. No. 6,691,781 presupposes a partially horizontal production well to render possible to carry out said separation. Consequently, such a separation method is not applicable in non-horizontal wells.

THE OBJECT OF THE INVENTION

The object of the invention is to provide a novel method and a novel apparatus for separating and injecting produced water down in a production well, wherein the disadvantages of the prior art are avoided or substantially reduced.

HOW TO ACHIEVE THE OBJECT

The object is achieved by means of features disclosed in the following description and in the subsequent claims.

The invention presupposes that a person skilled in the area will employ various known well technology and well equipment, for example well packers etc., to the degree necessary in order to adapt the invention to the well conditions at hand.

According to one aspect of the invention, a method of separating water from a water- and hydrocarbon-containing production flow in a production well is provided. The production flow emanates from at least one surrounding production formation. The method also involves injecting a resulting water-containing liquid into at least one surrounding disposal formation, whilst a resulting hydrocarbon-containing liquid is produced out of the production well. The expressions water-containing liquid and hydrocarbon-containing liquid do not presuppose 100% presence of water and hydrocarbons, respectively, but refer herein to main constituents of water and hydrocarbons, respectively.

The present method comprises the following steps:

(A) to arrange a first flow channel and a second flow channel within the production well (4), wherein:
- the first flow channel is structured to connect the production formation in a flow-communicating manner with an upstream side of at least one downhole water separation device; and
- the second flow channel is structured to connect the disposal formation in a flow-communicating manner with a downstream side of said downhole water separation device;

(B) from the production formation, to direct the production flow via the first flow channel and further to said upstream side of the water separation device, at which upstream side the production flow has a pressure $P_1$;

(C) to arrange the second flow channel with an internal pressure manipulation region having a pressure $P_2$, and being in pressure-communication with said downstream side of the water separation device;

(D) in water suction mode, to adjust the pressure $P_2$, in the pressure manipulation region to a pressure that is lower than the pressure $P_1$, in the production flow;

the action of which generates a pressure difference $P_1$-$P_2$ across the water separation device that sucks separated, water-containing liquid into the second flow channel, whilst hydrocarbons are retained in the water separation device and form said hydrocarbon-containing liquid;

(E) to produce the hydrocarbon-containing liquid in the first flow channel out of the production well; and (F) via the second flow channel, to inject the water-containing liquid into the disposal formation under the influence of an injection pressure $P_I$, that is higher than a total pressure $P_T$, exerted by the disposal formation against the injection pressure $P_I$, and which must be overcome to allow the water-containing liquid to be injected.

The distinctive characteristic of the method is that, in step (D), the pressure $P_2$, is provided by means of the following steps:

to connect the second flow channel in an adjustable manner with at least one external, first gas source;

by means of gas from the first gas source, to form a first gas column having a gas pressure $P_3$, in the second flow channel;

to connect the first gas column in a pressure-communicating manner with the pressure manipulation region, whereby the gas pressure $P_3$, in the first gas column corresponds with the pressure $P_2$, in the pressure manipulation region; and in water suction mode, to adjust the gas pressure $P_3$, in the first gas column to a pressure that is lower than the pressure $P_1$, in the production flow, whereby the pressure $P_2$ in the pressure manipulation region also is adjusted correspondingly.

The first flow channel may be structured as an inner pipe within an outer pipe in the production well, whilst the second flow channel is comprised of an annulus between the inner pipe and the outer pipe. Alternatively, the second flow channel may be structured as an inner pipe within an outer pipe in the production well, whilst the first flow channel is comprised of an annulus between the inner pipe and the outer pipe.

For example, the inner pipe may be comprised of a production tubing, a liner, a coiled tubing or a pipe spanning a longitudinal section of the well. Depending on the embodiment used, the outer pipe may, for example, be comprised of a casing or production tubing. The inner pipe may be provided centrically or eccentrically within the production well.

Said water separation device may comprise suitable separation devices according to prior art.

The water separation device may also comprise at least one hydrophilic and water-permeable material through which water from the production flow is sucked into the second flow channel due to said pressure difference $P_1$-$P_2$, whilst hydrocarbons are retained at the upstream side of the water-permeable material.

According to prior art, various materials and shapes may be used as said water-permeable material. Some of these are already mentioned hereinbefore under prior art.

As such the water-permeable material may, for example, be formed in a pipe wall, as a pipe wall, or in connection with a pipe wall. For example, the water-permeable material may be connected in a flow-through manner with the inner pipe (18) in at least one of the following positions:

in the pipe wall;

as the pipe wall;

at the outside of the pipe wall; and at the inside of the pipe wall.

For example, such a pipe wall may comprise, completely or partially, the aforementioned semi-permeable membrane material according to U.S. Pat. No. 4,241,787. Other membrane materials and/or shapes thereof may be used, as described in the aforementioned US 2002/0189807, and/or in U.S. Pat. No. 6,755,251.

Yet further, the water-permeable material may be structured as a tubular unit or module. The water-permeable material may also be comprised of a membrane material, for example a ceramic material. As such the water-permeable material may be composed of porous structures formed from ceramic membranes or other types of membranes, in which one or more such membranes are structured, for example, as said tubular units or modules, which are commercially available through various suppliers. In its operational position, such a tubular membrane unit or membrane module will slip a water-containing liquid, i.e. a permeate, radially through the pipe wall, whilst a hydrocarbon-containing liquid, i.e. a retentate, is retained. The permeate may flow radially inwards or radially outwards through the pipe wall, which depends on the manner in which said first flow channel is arranged relative to said second flow channel.

Said first gas source may be chosen amongst at least one of the following gas sources:

a gas source at the surface;

a gas source in a subsurface formation; and a gas source in the form of gas being separated from the well flow.

If the gas emanates completely or partially from a subsurface formation, the production flow must be formed with suitable gas inlet openings, for example perforations, through which gas may flow into the well.

Moreover, the first gas source may be connected with the second flow channel via at least one gas lift valve for introduction of production-stimulating lift gas in the production well.

In method step (D), the gas pressure $P_3$, in said first gas column may be provided by means of the following steps:

to locate a shallower level along the first flow channel where said hydrocarbon-containing liquid has a pressure $P_5$ that is lower than the pressure $P_2$, in the internal pressure manipulation region in the second flow channel; and via a gas-filled channel, to connect the first gas column with the first flow channel at said shallower level in the first flow channel.

Due to large density differences, the gas in the gas-filled channel will exert an insignificant pressure relative to the pressure of a corresponding and juxtaposed column of hydrocarbon-containing liquid in the first flow channel. Thereby the pressure $P_2$, in the internal pressure manipulation region may be adjusted to a pressure that is lower than said pressure $P_1$, in the water- and hydrocarbon-containing production flow, so as to suck in water from the production flow. In order to obtain a sufficient pressure difference $P_1$-$P_2$ across the water separation device, it is important that the channel is carried sufficiently far upwards in the well to enable it to be connected with the first flow channel at a shallower level where said pressure $P_5$, exists in the hydrocarbon-containing liquid. This allows the pressure $P_2$, to be kept relatively constant without a noteworthy supply of new gas from said first gas source, and this allows water to be sucked from the production flow. This, however, presupposes that the ambient operating conditions in the well, such as the fluid pressure in the production formation, the production rate of the well, and the required pressure difference $P_1$-$P_2$, across the water separation device, are appropriate for such an embodiment. Advantageously, the embodiment variant may also be used for introduction of production-stimulating lift gas in the production well.

As mentioned, produced water will normally have a substantially larger density than that of a hydrocarbon-containing fluid, especially if the fluid contains gas. A column of produced water, such as said water-containing liquid of this invention, will therefore exert a substantially higher hydrostatic pressure than that of a corresponding and juxtaposed column of the water- and hydrocarbon-containing production flow. In this invention, this gain in hydrostatic pressure is utilized as a contribution to said injection pressure $P_I$. However, the degree of utilization depends on the total pressure $P_T$ exerted by the disposal formation against the injection pressure $P_I$, when the water-containing liquid is to be injected into the disposal formation. In this connection, said total pressure $P_T$, may be comprised of the fluid pressure in the pores of the disposal formation (the pore pressure) and/or its fracture pressure near the injection region in the production well. As such the present invention may be used to inject the water-containing liquid into a porous and permeable disposal formation, for example a sandstone or limestone, or into a relatively non-porous and impermeable disposal formation, for example a siltstone, mudstone or shale.

In method step (F), said injection pressure $P_I$, may be provided in different ways. The manner in which the injection pressure $P_I$, is provided, depends to a large extent on the following conditions:

- the location of the disposal formation relative to the production formation;
- the rock type and nature of the disposal formation; and
- the magnitude of the total pressure $P_T$, which may be comprised of the pore pressure and/or the fracture pressure of the disposal formation.

In the simplest embodiment of the invention, the injection pressure $P_I$, may be provided by utilizing a combination of:

- the pressure $P_2$, in the pressure manipulation region when being in its water suction mode; and
- a hydrostatic pressure $P_H$, exerted by a column of the water-containing liquid extending down to the disposal formation.

When the injection pressure $P_I$, is provided in this manner, water separation and water injection will be carried out simultaneously. Such a pressure combination may, for example, be utilized for injection into a relatively porous and permeable disposal formation with a normal hydrostatic pore pressure gradient. If desirable, the second flow channel may be provided with a first check valve that allows throughput only to the disposal formation.

In another embodiment of the method, the second flow channel may be provided with a first check valve that allows throughput only to the disposal formation;

- but wherein, in step (F), said injection pressure $P_I$, is provided by means of the following steps:
- through adjustment of said gas pressure $P_3$, to increase the pressure $P_2$, in the pressure manipulation region to a pressure that is higher than the pressure $P_1$, in the production flow, whereby the pressure manipulation region is in water injection mode; and
- to combine the increased pressure $P_2$, with a hydrostatic pressure $P_H$, exerted by a column of the water-containing liquid extending down to the disposal formation.

When the injection pressure $P_I$, is provided in this manner, only water separation, and no water injection, is carried out. Such a pressure combination may, for example, be utilized for injection into an overpressured disposal formation, or for such injection at a fracture pressure. Through manipulation of said gas pressure $P_3$, and thus the pressure $P_2$, in the internal pressure manipulation region, the pressure manipulation region may be exposed to underpressure and overpressure, respectively, relative to the pressure $P_1$ in the production flow. Alternation between water suction mode and water injection mode in the pressure manipulation region is thus possible.

In this connection, the water-containing liquid may be filled into the second flow channel until it covers at least a portion of the pressure manipulation region, whereby water-containing liquid will flow back through said water separation device when the pressure manipulation region is in injection mode, thereby cleaning the water separation device.

If such a back-flow of liquid is not desirable, the water separation device may be provided with a check valve that prevents the back-flow.

In a further embodiment of the method, the second flow channel may be provided with a first check valve that allows throughput only to the disposal formation;

- but wherein, in step (F), the injection pressure $P_I$, on the contrary is provided by means of the following steps:
- to place a pump device in the second flow channel and in a position between the pressure manipulation region and the disposal formation, whereby the second flow channel is divided in a pressure-sealing manner into, respectively:
  - an upstream water suction chamber that comprises said pressure manipulation region; and
  - a downstream water injection chamber between the pump device and the disposal formation;
- by means of the pump device, to exert a pump pressure $P_P$, on a column of the water-containing liquid in the water suction chamber; and
- to combine the pump pressure $P_P$, with a hydrostatic pressure $P_H$, exerted by said water-containing liquid column.

When the pump device exerts its pressure $P_P$, on the water-containing liquid column, only water injection will be carried out. However, inflow of the water-containing liquid into the water suction chamber is primarily controlled via the gas pressure $P_3$, in said first gas column. Thereby water may be separated continuously from the production flow and be directed into the water suction chamber, whilst the water-containing liquid in the water suction chamber is injected periodically into the disposal formation.

If desirable to avoid utilization of a downhole pump device, an alternative embodiment of the method may be used, which comprises the following steps:

- to provide the second flow channel with a first check valve that allows throughput only to the disposal formation;
- to divide the second flow channel into, respectively:
  - an upstream water suction chamber that comprises the pressure manipulation region and the first gas column; and
  - a downstream water injection chamber that comprises a second gas column having a gas pressure $P_4$;
- to connect the water suction chamber in a flow-communicating manner with the water injection chamber via a second check valve that allows throughput only to the water injection chamber;
- to connect the second gas column in a flow-communicating and adjustable manner with at least one external, second gas source;
- when the water-containing liquid fills the water injection chamber to an upper water level, to direct overpressured gas into the water injection chamber and force the water-containing liquid down to a lower water level in the water injection chamber, whereby the water-containing liquid is injected into the disposal formation; and
- when the water-containing liquid is located at the lower water level, to shut off the gas inflow and then direct overpressured gas out of the second gas column and thus reduce said gas pressure $P_4$, until the second check valve opens so as to allow the water-containing liquid to flow into the water injection chamber again.

When the injection pressure $P_I$, is provided by means of using a gas pressure $P_4$, in a second gas column in the water injection chamber, the water-containing liquid is injected periodically into the disposal formation, although without utilizing a pump device. Meanwhile, water separation may continue without interruption.

In this connection, said second gas source may be chosen amongst at least one of the following gas sources:

- a gas source at the surface;

a gas source in a subsurface formation; and a gas source in the form of gas being separated from the well flow.

The second gas source may be connected with the water injection chamber via at least one gas lift valve for introduction of production-stimulating lift gas in the production well.

Said first gas source and second gas source may also be comprised of the same gas source. In this connection, suitable, known valve and control devices must be used to direct gas appropriately onwards to and from of the target region.

Moreover, said water injection chamber may be connected with the following devices:

a water level stop device structured to stop outflow of the water-containing liquid to the disposal formation at least when the water-containing liquid is located at the lower water level; and a gas flow control device structured to be able to carry out the following functions:

to register when the water-containing liquid is located at the lower water level and, based on this, to direct overpressured gas out of the second gas column until the water-containing liquid again may flow into the water injection chamber; and to register when the water-containing liquid is located at the upper water level and, based on this, to direct overpressured gas into the water injection chamber.

The water level stop device may include sensors known per se, which may distinguish a liquid from a gas at said water levels. Such sensors distinguish differences in physical properties of the liquid and the gas, for example differences in pressure, density, temperature, resistivity, acoustic travel time, optical properties and alike.

In one embodiment, however, said water level stop device may be in the form of:

a partition with a flow-through float seat arranged at the lower water level; and a float arranged above the partition and having a shape that stops through-flow when it is in contact with, and is forced against, the float seat. In an alternative embodiment (not shown), the float may be placed between two such partitions with flow-through float seats, in which one partition is placed at each of water levels. Then the float will stop through-flow when it is in contact with one of said float seats.

Furthermore, the method may also comprise:

to connect the gas flow control device with the water injection chamber; and to provide the gas flow control device with at least one directional control valve for allowing control of the flow of overpressured gas to and from the second gas column in the water injection chamber.

In order to control the flow of overpressured gas to and from the second gas column, the gas flow control device may also be connected to known devices and sensors capable of distinguishing different properties of a liquid and/or gas at said water levels. The gas flow control device may then be structured to be able to register such differences and/or properties and, based on this, allow control of said flow of overpressured gas to and from the second gas column. Said sensors may, for example, distinguish differences in pressure, density, temperature, resistivity, acoustic travel time, optical properties and alike.

Said gas in the first and/or second gas source may also be composed of any suitable gas, for example a hydrocarbon gas, air, carbon dioxide or nitrogen. The gas may be directed down into the production well from the surface, or it may be directed in from a subsurface, gas-containing formation.

Gas used for so-called gas lifting, and which is mixed into the production flow down within the well in order to facilitate the outflow thereof, may also be utilized to generate said gas pressure $P_3$, and possibly said gas pressure $P_4$. In this connection, gas is directed in an alternating manner into the second flow channel and into the outflowing fluid so as to be of assistance to the water separation, the gas lift, and the water injection, respectively.

In step (A), the method may also be used to connect the first flow channel in a flow-communicating manner with a production formation located shallower or deeper than the disposal formation.

As an alternative, the method, in step (F), may also be used to connect the second flow channel in a flow-communicating manner with at least one layer of the production formation, whereby the production formation also comprises said disposal formation. Preferably, such a disposal layer is underlying a hydrocarbon-containing layer of the production formation. Water-containing liquid injected into the disposal layer may thus contribute to provide pressure-support to the hydrocarbon-containing layer and thus contribute to increase the recovery therefrom.

According to a second aspect of the invention, an apparatus that may be used to carry out the method according to the invention is provided. The apparatus comprises constructive features corresponding to features of the present method.

In its most general form of construction, the apparatus comprises a first flow channel and a second flow channel, both of which are arranged within said production well;

wherein the first flow channel is structured to connect the production formation in a flow-communicating manner with an upstream side of at least one downhole water separation device;

insofar as the upstream side of the water separation device, when in its operational position, is in contact with said production flow having there a pressure $P_1$;

wherein the second flow channel is structured to connect the disposal formation in a flow-communicating manner with a downstream side of said downhole water separation device; and wherein the second flow channel is arranged with an internal pressure manipulation region having a pressure $P_2$, and being in pressure-communication with said downstream side of the water separation device;

insofar as the pressure $P_2$, in the pressure manipulation region, when in its water suction mode, is adjusted to a pressure that is lower than the pressure $P_1$, in the production flow, the action of will generate a pressure difference $P_1$-$P_2$ across the water separation device that will suck separated, water-containing liquid into the second flow channel, whilst hydrocarbons will be retained in the water separation device and form said hydrocarbon-containing liquid; and wherein the water-containing liquid is injected into the disposal formation via the second flow channel, and under the influence of an injection pressure $P_I$, that is higher than a total pressure $P_T$, exerted by the disposal formation against the injection pressure $P_I$, and which must be overcome to allow the water-containing liquid to be injected.

The distinctive characteristic of the apparatus is that the second flow channel is adjustably connected with at least one external, first gas source;

wherein the second flow channel is provided with a first gas column having a gas pressure $P_3$, the first gas column being formed by means of gas from the first gas source;

wherein first gas column is connected in a pressure-communicating manner with the pressure manipulation region, whereby the gas pressure $P_3$, in the first gas column is arranged to correspond with the pressure $P_2$, in the pressure manipulation region; and wherein the first gas column is connected to a gas control device for adjusting the gas pressure $P_3$, in the first gas column, whereby the pressure $P_2$, in the pressure manipulation region also is adjusted correspondingly.

ADVANTAGES OF THE INVENTION

This invention differs from other prior art methods in that:

the invention requires only a small number of components;

the invention requires few movable components;

it is not necessary to use pumps, which have a limited lifetime;

the invention may be used in new wells and also be installed in existing wells;

the invention may be used independent of flow rate;

the invention may be used both in vertical and horizontal wells;

the invention may be used together with existing gas lift systems in a well; and the water-containing liquid may be injected into a disposal zone overlying or underlying the production formation of the well, but also into a disposal zone of the production formation.

SHORT DESCRIPTION OF THE FIGURES

Non-restricting examples of embodiments of the present invention are described in the following, whilst referring to the associated figures, in which.

Figure 1:
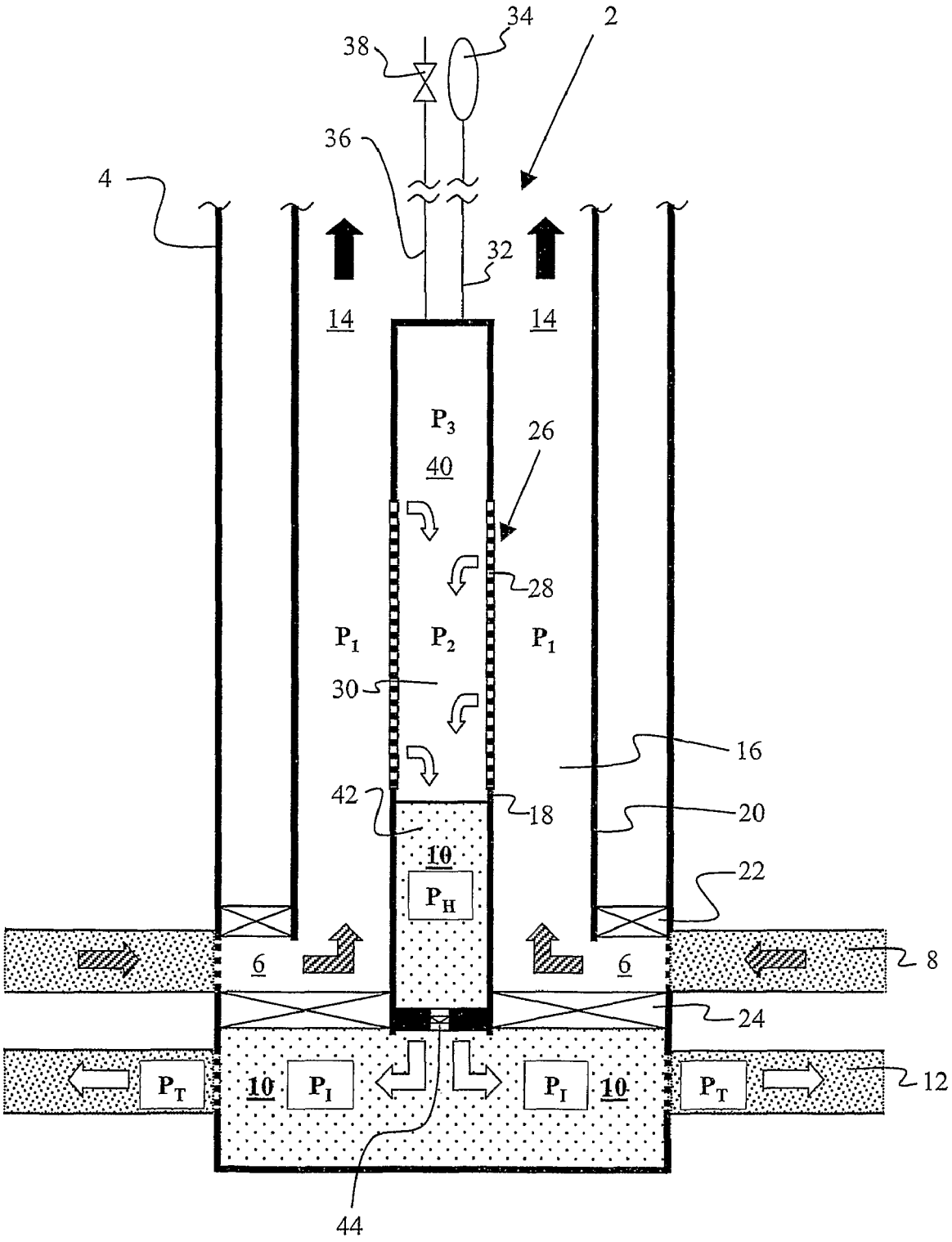
FIG. 1 shows a schematic front view of a first embodiment of the invention, in which a water-containing liquid is separated, as a permeate, from a production flow and is injected into an underlying disposal formation via an inner pipe in a production well.
Figure 3:
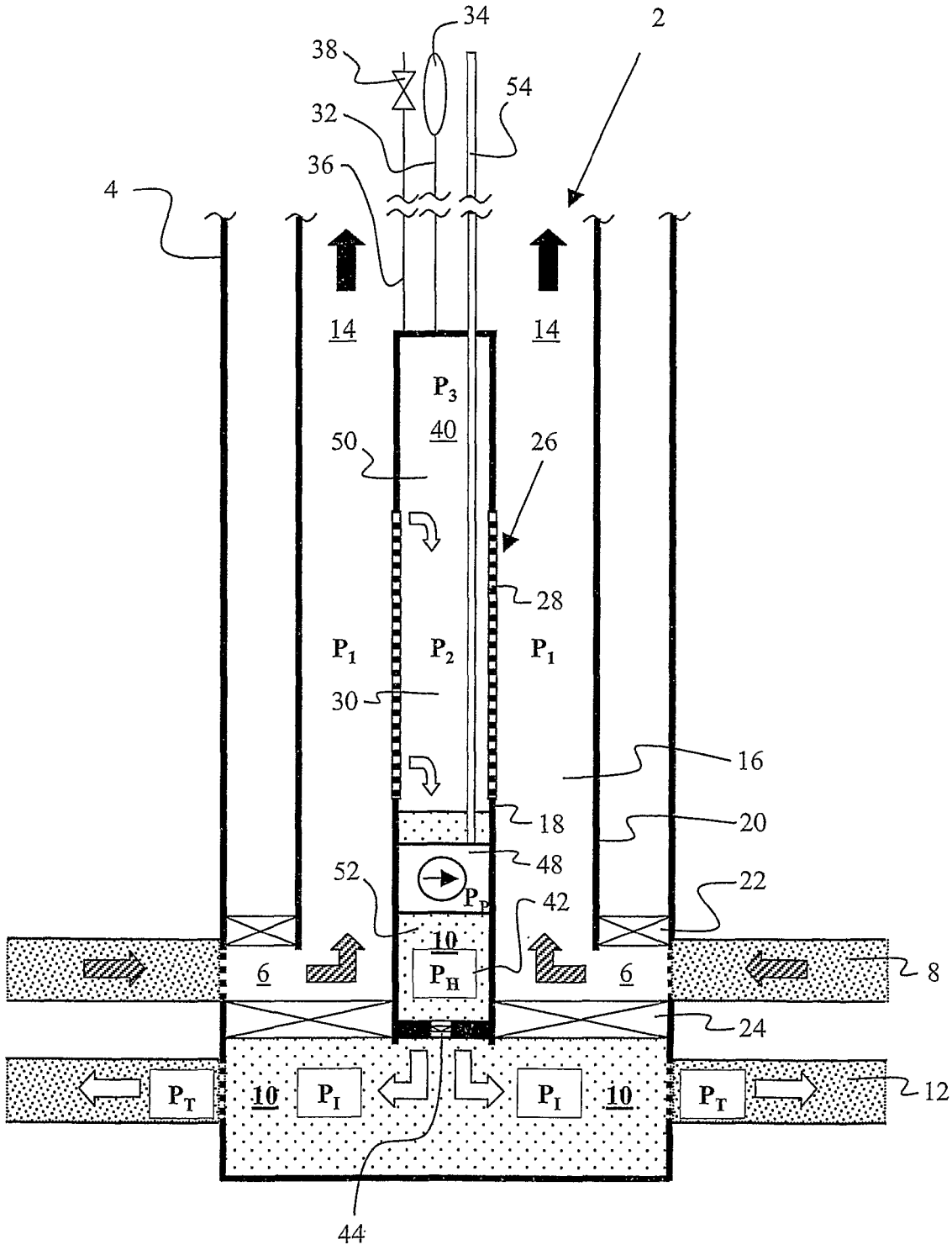

FIG. 3 shows a schematic front view of a third embodiment of the invention resembling substantially the embodiment according to FIG. 1, but in which said inner pipe is provided with a pump device for injection of said permeate into the disposal formation; and FIGS. 4-7 shows a schematic front view of different steps in a fourth embodiment of the invention, in which a water-containing liquid is separated, as a permeate, from a production flow and is injected into an underlying disposal formation via an inner pipe that comprises a water suction chamber and a water injection chamber.

The attached figures are strongly simplified and only show the essential and symbolically depicted components of the invention. Moreover, the shape, relative dimensions and mutual positions of the components are distorted. Equal, equivalent or corresponding details in the figures will generally be assigned the same reference numeral in the following.

DESCRIPTION OF EXAMPLES OF EMBODIMENTS OF THE INVENTION

FIGS. 1-7 all show an apparatus 2 according to the invention. In a production well 4, the apparatus 2 is used to separate water from a water- and hydrocarbon-containing production flow 6 emanating from a production formation 8. The apparatus 2 is also used to inject a resulting water-containing permeate 10 into a disposal formation 12, whilst a resulting hydrocarbon-enhanced retentate 14 is produced to the surface. In the figures, the production flow 6; the flow of permeate 10; and the flow of retentate 14; are depicted with hachured arrows; white arrows; and black arrows, respectively. Among other things, the apparatus 2 comprises a first flow channel and a second flow channel, both of which are arranged within the production well 4.

Figure 2:
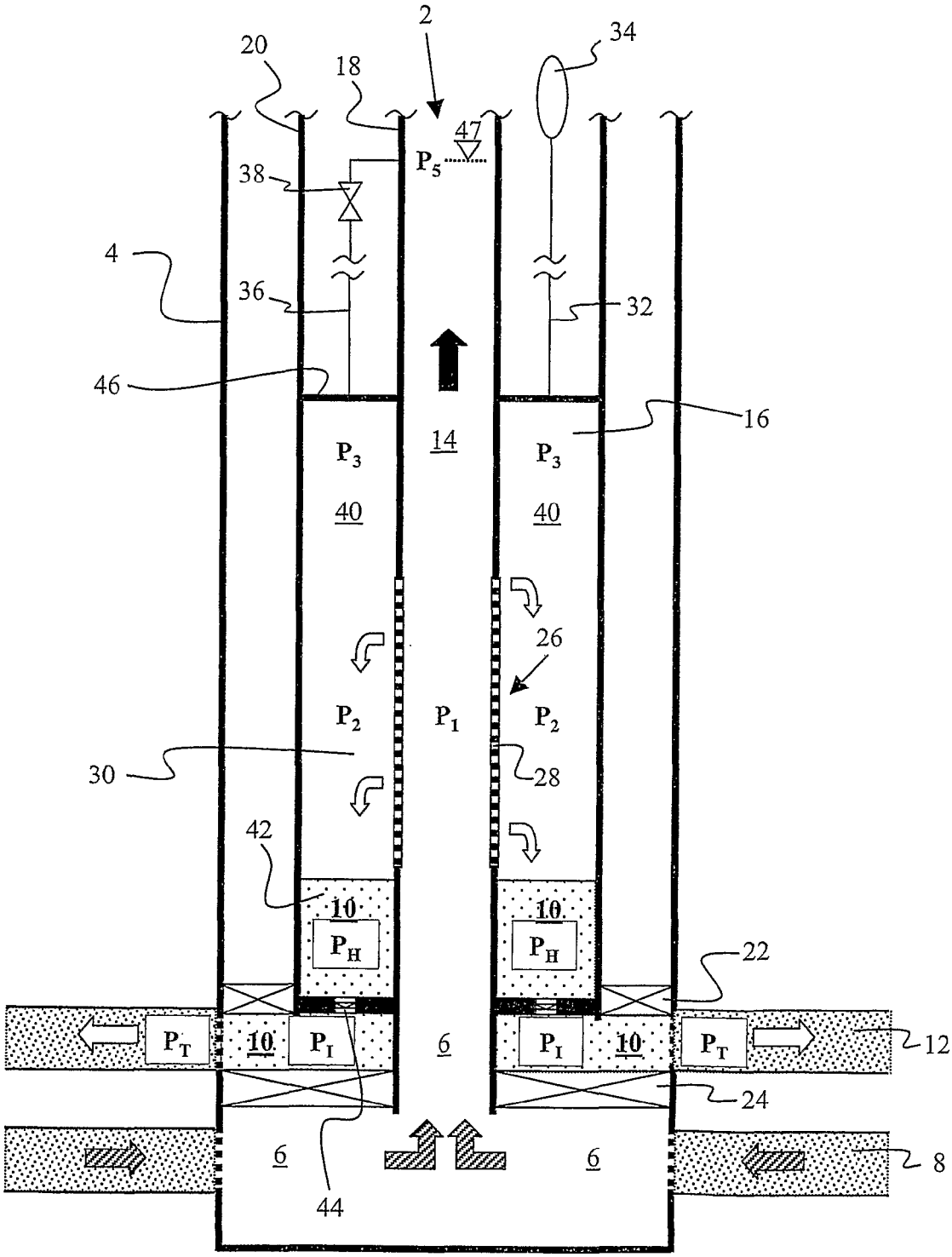
FIG. 2 shows a schematic front view of a second embodiment of the invention, in which a water-containing liquid is separated, as a permeate, from a production flow and is injected into an overlying disposal formation via an annulus surrounding an inner pipe in a production well.

The examples of embodiments shown in FIG. 1 and FIG. 2 show the simplest forms of the apparatus 2.

In the example of an embodiment according to FIG. 1, the first flow channel is comprised of an annulus (16) between an inner pipe 18 and an outer pipe 20, whilst the second flow channel is comprised of the inner pipe 18. The annulus 16 is connected in a flow-communicating manner with the production formation 8, which in this example is located shallower than the disposal formation 12.

In this example, the inner pipe 18 spans a specific vertical length of the well 4 and is shut off at an upper end thereof, whilst the outer pipe 20, which in this example is in the form of a production tubing, extends to the surface. The outer pipe 20 is sealed against the well bore by means of at least one well packer 22 arranged immediately above the production formation 8. The inner pipe 18 is sealed against the well bore by means of at least one well packer 24 arranged immediately above the disposal formation 12.

The annulus 16 is arranged to connect the production formation 8 in a flow-communicating manner with a water separation device 26, whilst the inner pipe 18 is in flow-communication with the disposal formation 12. In all examples of embodiments, the water separation device 26 is comprised of a tubular water separation module arranged in the pipe wall of the inner pipe 18, the module of which is comprised of a hydrophilic and water-permeable membrane material 28, which may, for example, be formed from a ceramic material. An upstream side of the membrane material 28 is in contact with the production flow 6 having there a pressure $P_1$. Vis-à-vis the membrane material 28, the inner pipe 18 is arranged with an internal pressure manipulation region 30 having a pressure $P_2$, and being in pressure-communication with a downstream side of the membrane material 28. When the pressure manipulation region 30 is in water suction mode, the pressure $P_2$, therein is adjusted to a pressure that is lower than the pressure $P_1$, in the production flow 6. Thereby a pressure difference $P_1$-$P_2$, across the membrane material 28 will suck water from the production flow 6 through the membrane material 28 and into the inner pipe 18, whilst the membrane material 28 will retain hydrocarbons and form said hydrocarbon-containing retentate 14.

Said upper end of the inner pipe 18 is connected to a gas supply pipe 32 from a first gas source 34, which in this example is a gas source at the surface, and a gas discharge pipe 36. The gas discharge pipe 36 is provided with a pressure control device 38, which in this example is in the form of a gas control valve and/or a check valve. The discharge pipe 36 extends up to a suitable level in the well 4, or to the surface.

Also the inner pipe 18 according to FIG. 1 is provided with a first gas column 40 having a gas pressure $P_3$, the gas column 40 being formed by means of gas from said first gas source 34. The gas column 40 is connected in a pressure-communicating manner with said pressure manipulation region 30. Thereby the gas pressure $P_3$, is arranged to correspond with the pressure $P_2$, in the pressure manipulation region 30. By directing gas from the gas column 40 via said gas control valve 38 and out to said overlying level in the well 4, the gas pressure $P_3$, in the gas column 40 is adjusted. Thereby the pressure $P_2$, in the pressure manipulation region 30 is also adjusted correspondingly, so at to allow the pressure difference $P_1$-$P_2$, and the inflow rate of the permeate 10 to be adjusted. If desirable, the gas directed from the gas column 40 may be used as lift gas in the production well 4.

If desirable, the inner pipe 18 may also be comprised of a coiled tubing (not shown) extending to the surface, but wherein an upper portion thereof is shut off and adjustably connected with a first gas source 34 and a gas discharge pipe 36.

The apparatus 2 is also used to inject the water-containing permeate 10 into the disposal formation 12 via the inner pipe 18. This is carried out under the influence of an injection pressure $P_I$, that is higher than a total pressure $P_T$, exerted by the disposal formation 12 against the injection pressure $P_I$, and which must be overcome to allow the water-containing permeate 10 to be injected.

The injection pressure $P_I$, has been provided through a combination of:

- the pressure ($P_2$) in the pressure manipulation region 30 when being in its water suction mode; and
- a hydrostatic pressure $P_H$, exerted by a column 42 of the water-containing permeate 10 extending down to the disposal formation 12. Water separation and water injection are carried out simultaneously at this injection pressure $P_I$.

By supplying gas from the first gas source 34, the injection pressure $P_I$, may also be increased further. It is thus possible to alternate between water suction mode and injection mode in the gas column 40.

The inner pipe 18 is also provided with a first check valve 44 that allows throughput only to the disposal formation 12, and which is of a shape that fits within the pipe 18.

Reference is now made to the example of an embodiment according to FIG. 2. In this embodiment, however, the first flow channel is comprised of an inner pipe 18 arranged within an outer pipe 20 in the production well 4, whilst the second flow channel is comprised of an annulus 16 between the inner pipe 18 and the outer pipe 20. The inner pipe 18 is connected in a flow-communicating manner with the production formation 8, which in this example is located deeper than the disposal formation 12.

In this example, the inner pipe 18 is comprised of a production tubing extending to the surface, whilst the outer pipe 20 is in the form of a casing or liner extending completely or partially to the surface. Also in this example, the pipes 18, 20 are sealed against the well bore by means of well packers 22, 24, and a tubular water separation module 26 with a water-permeable membrane material 28 arranged in the pipe wall of the inner pipe 18 is utilized, similar to the previous example of an embodiment. FIG. 2 also shows that the annulus 16 is shut off a distance above the water separation module 26 by means of a shut-off device 46, for example an annulus packer. The shut-off device 46 is connected to a gas supply pipe 32 from a first gas source 34, which in this example is a gas source at the surface, as described in the previous example of an embodiment. In contrast to the first gas column 40 shown in FIG. 1, the first gas column 40 according to FIG. 2 is located in the annulus 16.

Vis-à-vis the membrane material 28, the annulus 16 is arranged with a pressure manipulation region 30 having a pressure $P_2$, and being in pressure-communication with a downstream side of the membrane material 28. By means of said pressure difference $P_1$-$P_2$, across the membrane material 28, water is sucked from the production flow 6 through the membrane material 28 and into the annulus 16. Then the water-containing permeate 10 is injected into the disposal formation 12 via the annulus 16, and under the influence of an injection pressure $P_I$, that is higher than said total pressure $P_T$, in the disposal formation 12. The annulus 16 is also provided with a first check valve 44 that allows throughput only to the disposal formation 12, and which is of a shape that fits within the annulus 16.

In this example of an embodiment, the first gas column 40 is connected with the inner pipe 18 via a gas-filled discharge pipe 36. The discharge pipe 36 is connected with the inner pipe 18 at a shallower level 47 where the retentate 14 has a pressure $P_5$, that is lower than the pressure $P_2$, in the pressure manipulation region 30 in the annulus 16. The gas discharge pipe 36 is also provided with a check valve 38 that allows throughput of gas only to the inner pipe 18. In this example, the gas discharge pipe 36 is also used for introduction of production-stimulating lift gas in the inner pipe 18, insofar as lift gas is directed from the first gas source 34 via the annulus 16. It is obvious that a corresponding variant of this manner of adjusting the pressure $P_2$, in the pressure manipulation region 30 also may be used for the embodiment according to FIG. 1. The latter may, for example, be carried out by extending said upper end of the inner pipe 18 up to, or to connect it with, a shallower level 47 in said outer pipe 20 where the retentate 14 has a pressure $P_5$.

Reference is now made to FIGS. 3-7. All figures show an apparatus 2 based on the embodiment according to FIG. 1, in which the first flow channel is comprised of the annulus 16, whilst the second flow channel is comprised of the inner pipe 18.

Also the example of an embodiment according to FIG. 3 shows an inner pipe 18 provided with said first check valve 44 that allows throughput only to the disposal formation 12. The apparatus 2 according to this embodiment, however, comprises a pump device 48 placed within the inner pipe 18 and in a position between the pressure manipulation region 30 and the disposal formation 12. Thereby the second flow channel is divided in a pressure-sealing manner into, respectively:

- an upstream water suction chamber 50 that comprises said pressure manipulation region 30; and
- a downstream water injection chamber 52 between the pump device 48 and the disposal formation 12.

In this example of an embodiment, the pump device 48 is connected with a connection line 54 for supplying the pump device 48 with power and control signals from the surface.

Said injection pressure $P_I$, for overcoming the total pressure $P_T$, in the disposal formation 12 has been provided by means of:

- having a pump pressure $P_P$, from the pump device 48 exerted on a column 42 of the water-containing permeate 10 in the water suction chamber 50; and by means of:
- having the pump pressure $P_P$, combined with a hydrostatic pressure $P_H$, exerted by said permeate column 42. Water injection is carried out at this injection pressure $P_I$.

FIGS. 4-7 show a last example of an embodiment of the apparatus 2, in which said figures show different steps in the application of the apparatus 2.

Also the example of an embodiment according to FIGS. 4-7 shows an inner pipe 18 provided with said first check valve 44 that allows throughput only to the disposal formation 12. The inner pipe 18 according to this embodiment, however, is divided into, respectively:

- an upstream water suction chamber 50 that comprises the pressure manipulation region 30 and the first gas column 40; and a downstream water injection chamber 52 that comprises a second gas column 56 having a gas pressure $P_4$.

The water suction chamber 50 is connected in a flow-communicating manner with the water injection chamber 52 via a second check valve 58 that allows throughput only to the water injection chamber 52, and which is of a shape that fits within the inner pipe 18. The upper end of the inner pipe 18 is also connected to said gas discharge pipe 36 extending up to an overlying level in the well 4, and which is provided with said gas control valve, possibly check valve, 38.

The second gas column 56 is connected with a gas flow control device 60 via a first gas pipe 62 connected to the inner pipe 18 vis-à-vis the gas column 56, whilst the first gas column 40 is connected with the gas flow control device 60 via a second gas pipe 64. The gas flow control device 60 is also connected to said gas supply pipe 32 from said first gas source 34 at the surface, and it is provided with at least one directional control valve 66 for allowing control of a flow of overpressured gas to and from the second gas column 56 in the water injection chamber 52.

Figure 4:
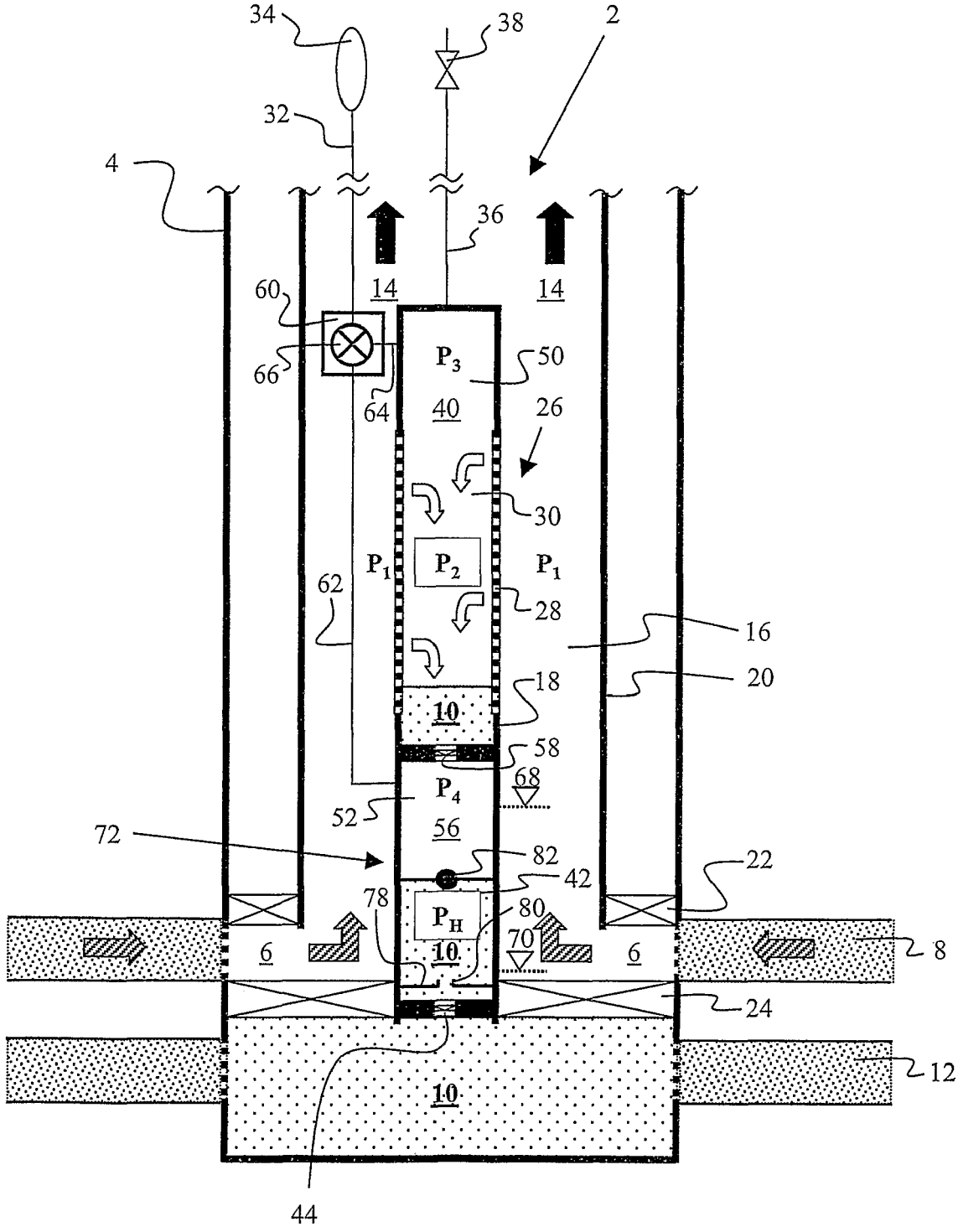
Figure 5:
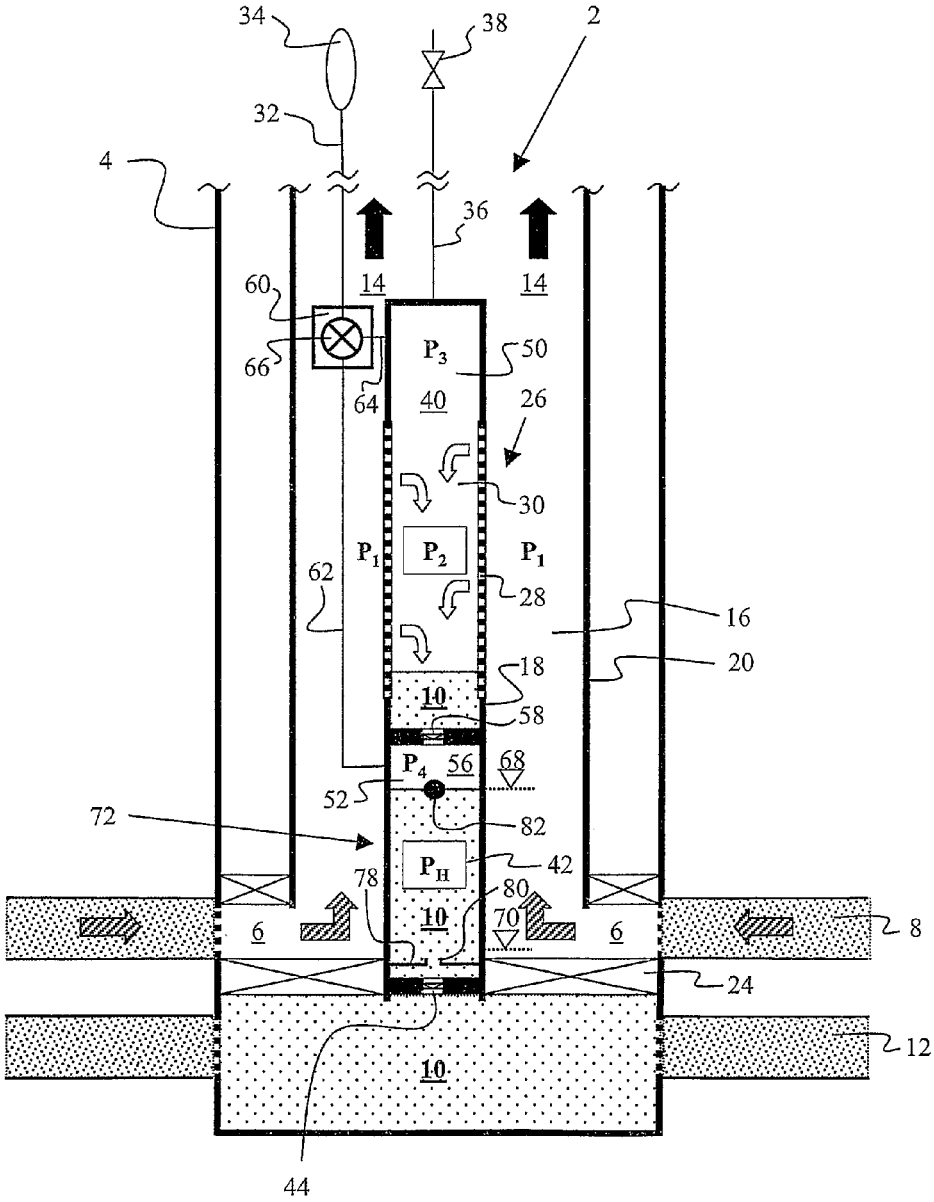

By means of the gas control valve/check valve 38 and/or the gas flow control device 60, the pressure $P_3$, in the first gas column 40, and thus the inflow rate of the water-containing permeate 10 into the inner pipe 18, is controlled. The permeate 10 flows continuously into the water injection chamber 52 via the second check valve 58 and gradually fills the water injection chamber 52. FIG. 4 shows a partially filled water injection chamber 52 when in the process of being filled with permeate 10, which flows into the water suction chamber 50 via the second check valve 58.

When the water-containing permeate 10 fills the water injection chamber 52 to an upper water level 68, the overpressured gas is directed into the water injection chamber 52 and forces the permeate 10 down to a lower water level 70 in the water injection chamber 52, whereby the permeate 10 is injected into the disposal formation 12.

Figure 6:
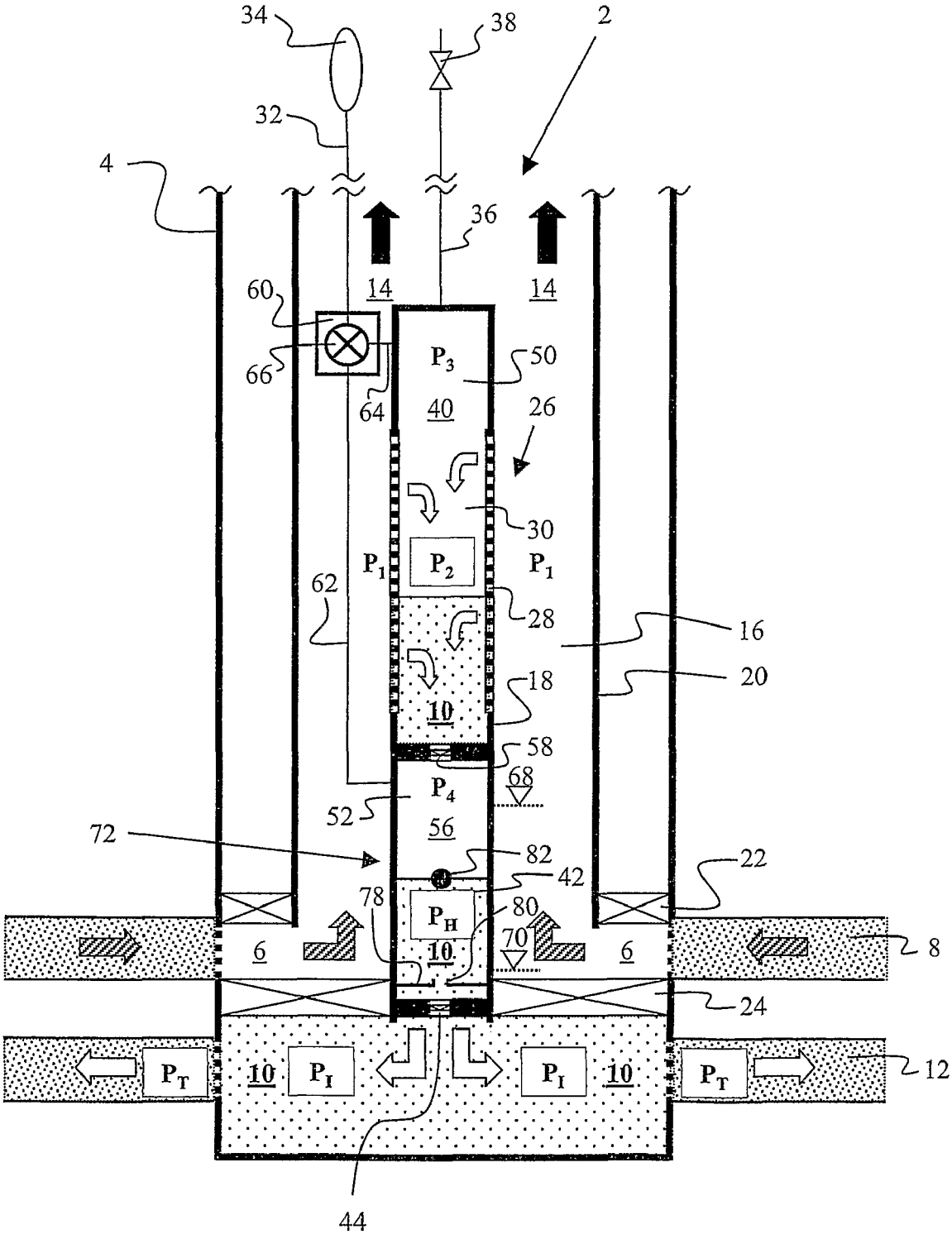
Figure 7:
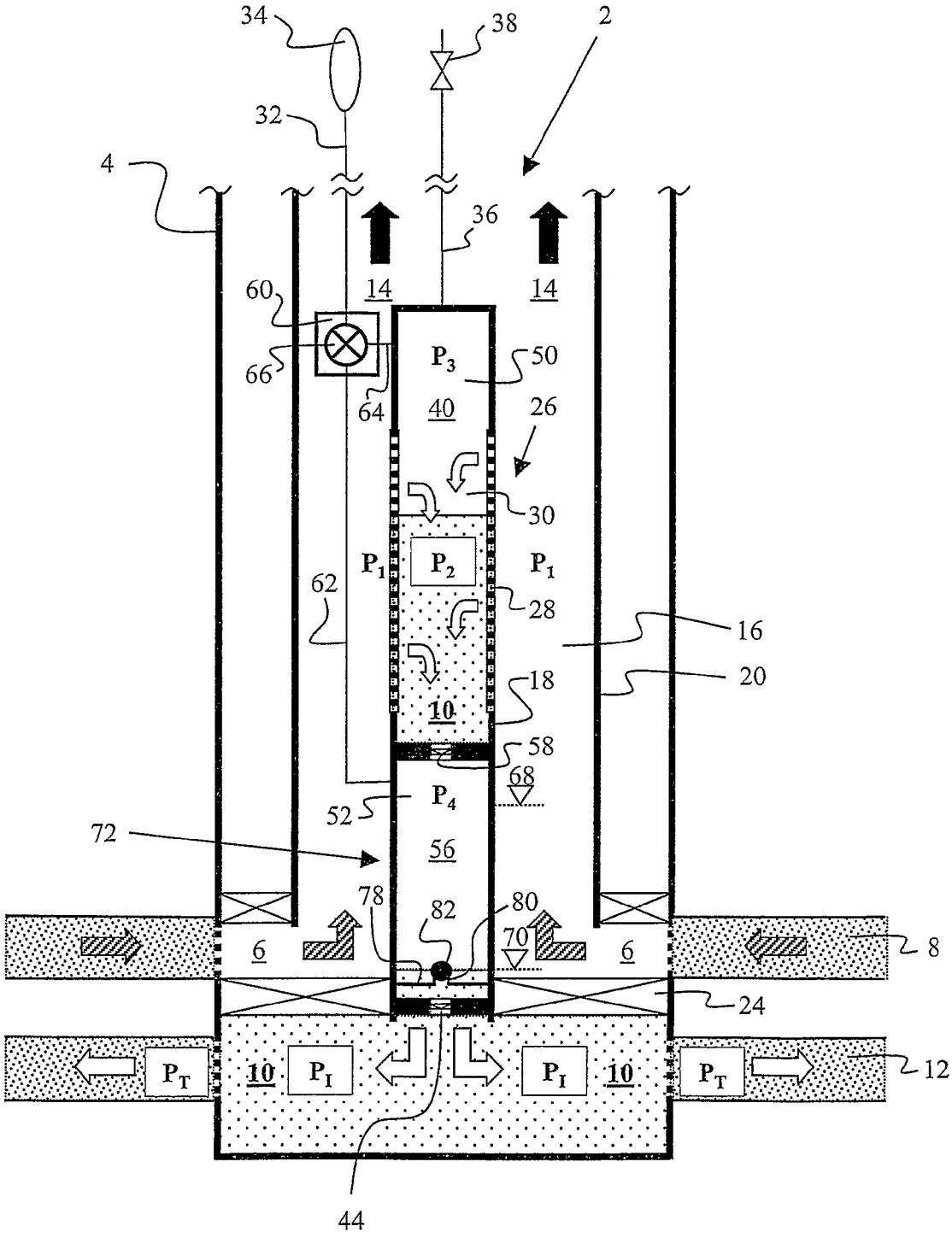

FIG. 6 shows a partially emptied water injection chamber 52 when in the process of being emptied during the course of injection, whilst FIG. 7 shows an emptied water injection chamber 52 at the end of the course of injection. Meanwhile, water separation continues without interruption in the water suction chamber 50 so as to gradually fill it, as shown in FIGS. 6 and 7.

When the permeate 10 has been forced down to the lower water level 70, the gas inflow is shut off. Then overpressured gas is directed out of the second gas column 56 via said first gas pipe 62. Thereby the gas pressure $P_4$, in the second gas column 56 is reduced until said second check valve 58 opens so as to allow the permeate 10 to flow into the water injection chamber 52 again.

In addition to said gas flow control device 60, the water injection chamber 52 is connected with a water level stop device 72 structured to stop outflow of the permeate 10 at least when it is located at the lower water level 70, which causes a build-up in the gas pressure $P_4$, in the second gas column 56.

I this connection, the gas flow control device 60 is structured to be able to carry out the following functions:

to register said build-up in the gas pressure $P_4$, and, based on this, direct overpressured gas out of the second gas column 56 until the permeate 10 again may flow into the water injection chamber 52; and to register when the permeate 10 is located at the upper water level 68 and, based on this, direct overpressured gas into the water injection chamber 52.

In this example of an embodiment, the water level stop device 72 in the inner pipe 18 is comprised of:

a lower partition 78 with a flow-through float seat 80 arranged at the lower water level 70; and a float 82 arranged above the partition 78 and having a shape structured to stop through-flow when it is in contact with, and is forced against, the float seat 80. In this example, the float 82 is ball-shaped.

Said gas flow control device 60 is structured to be able to direct overpressured gas out of the second gas column 56 via said first and second gas pipe 62, 64 and further into the water suction chamber 50 when the gas flow control device 60 registers said build-up in the gas pressure $P_4$, in the water injection chamber 52. This course of gas flow will continue until the gas pressure $P_3$, in the water suction chamber 50 is balanced with the gas pressure $P_4$, in the water injection chamber 52 via said second check valve 58 in the inner pipe 18. In an alternative not shown here, overpressured gas may be directed out into the annulus 16.

It is also possible to control the gas pressures $P_3$, and $P_4$, by means of independent gas flow control devices, and possibly also by means of independent gas sources. It is also possible to use gas sources having a different origin and being of a different gas type. Gas vented from the apparatus 2 may also be used as lift gas in the production well 4.

The invention claimed is:

1. A method of separating, in a production well, water from a water- and hydrocarbon-containing production flow emanating from at least one surrounding production formation; and of injecting, in the production well, a resulting water-containing liquid into at least one surrounding disposal formation, whilst a resulting hydrocarbon-containing liquid is produced out of the production well;

in which the method comprises the following steps:

(A) to arrange a first flow channel and a second flow channel within the production well, wherein:

the first flow channel is structured to connect the production formation in a flow-communicating manner with an upstream side of at least one downhole water separation device; and the second flow channel is structured to connect the disposal formation in a flow-communicating manner with a downstream side of said downhole water separation device;

(B) from the production formation, to direct the production flow via the first flow channel and further to said upstream side of the water separation device, at which upstream side the production flow has a pressure ($P_1$);

(C) to arrange the second flow channel with an internal pressure manipulation region having a pressure ($P_2$), and being in pressure-communication with said downstream side of the water separation device;

(D) in water suction mode, to adjust the pressure ($P_2$) in the pressure manipulation region to a pressure that is lower than the pressure ($P_1$) in the production flow;

the action of which generates a pressure difference ($P_1$-$P_2$) across the water separation device that sucks separated, water-containing liquid into the second flow channel, whilst hydrocarbons are retained in the water separation device and form said hydrocarbon-containing liquid;

(E) to produce the hydrocarbon-containing liquid in the first flow channel out of the production well; and (F) via the second flow channel, to inject the water-containing liquid into the disposal formation under the influence of an injection pressure ($P_I$) that is higher than a total pressure ($P_T$) exerted by the disposal formation against the injection pressure ($P_I$), and which must be overcome to allow the water-containing liquid to be injected, wherein, in step (D), the pressure ($P_2$) is provided by means of the following steps:

to connect the second flow channel with at least one external, first gas source;

by means of gas from the first gas source, to form a first gas column having a gas pressure ($P_3$) in the second flow channel;

to connect the first gas column in a pressure-communicating manner with the pressure manipulation region, whereby the gas pressure ($P_3$) in the first gas column corresponds with the pressure ($P_2$) in the pressure manipulation region; and in water suction mode, to adjust the gas pressure ($P_3$) in the first gas column to a pressure that is lower than the pressure ($P_1$) in the production flow, whereby the pressure ($P_2$) in the pressure manipulation region also is arranged correspondingly.

2. The method according to claim 1, wherein the first flow channel is structured as an inner pipe within an outer pipe in the production well, whilst the second flow channel is comprised of an annulus between the inner pipe and the outer pipe.

3. The method according to claim 1, wherein the second flow channel is structured as an inner pipe within an outer pipe in the production well, whilst the first flow channel is comprised of an annulus between the inner pipe and the outer pipe.

4. The method according to claim 1, wherein the water separation device comprises at least one hydrophilic and water-permeable material through which water from the production flow is sucked into the second flow channel due to said pressure difference ($P_1$-$P_2$), whilst hydrocarbons are retained at the upstream side of the water-permeable material.

5. The method according to claim 4, wherein the water-permeable material is connected in a flow-through manner with the inner pipe in at least one of the following positions:

in the pipe wall;

as the pipe wall;

at the outside of the pipe wall; and at the inside of the pipe wall.

6. The method according to claim 4, wherein the water-permeable material is comprised of a membrane material.

7. The method according to claim 1, wherein said first gas source is selected from the group consisting of the following gas sources:

a gas source at the surface;

a gas source in a subsurface formation; and a gas source in the form of gas being separated from the well flow.

8. The method according to claim 1, wherein the first gas source is connected with the second flow channel via at least one gas lift valve for introduction of production-stimulating lift gas in the production well.

9. The method according to claim 1, wherein, in step (D), the gas pressure ($P_3$) in said first gas column is provided by means of the following steps:

to locate a shallower level along the first flow channel where said hydrocarbon-containing liquid has a pressure ($P_5$) that is lower than the pressure ($P_2$) in the internal pressure manipulation region in the second flow channel; and via a gas-filled discharge channel, to connect the first gas column with the first flow channel at said shallower level in the first flow channel.

10. The method according to claim 1, wherein, in step (F), said injection pressure ($P_I$) is provided by utilizing a combination of:

the pressure ($P_2$) in the pressure manipulation region when being in its water suction mode; and a hydrostatic pressure ($P_H$) exerted by a column of the water-containing liquid extending down to the disposal formation;

at which injection pressure ($P_I$) water separation and water injection are carried out simultaneously.

11. The method according to claim 1, wherein the second flow channel is provided with a first check valve that allows throughput only to the disposal formation; and wherein, in step (F), said injection pressure ($P_I$) is provided by means of the following steps:

through adjustment of said gas pressure ($P_3$), to increase the pressure ($P_2$) in the pressure manipulation region to a pressure that is higher than the pressure ($P_1$) in the production flow, whereby the pressure manipulation region is in water injection mode; and to combine the increased pressure ($P_2$) with a hydrostatic pressure ($P_H$) exerted by a column of the water-containing liquid extending down to the disposal formation;

at which injection pressure ($P_I$) only water separation, and no water injection, is carried out.

12. The method according to claim 1, wherein the second flow channel is provided with a first check valve that allows throughput only to the disposal formation; and wherein, in step (F), said injection pressure ($P_I$) is provided by means of the following steps:

to place a pump device in the second flow channel and in a position between the pressure manipulation region and the disposal formation, whereby the second flow channel is divided in a pressure-sealing manner into, respectively:

an upstream water suction chamber that comprises said pressure manipulation region; and a downstream water injection chamber between the pump device and the disposal formation;

by means of the pump device, to exert a pump pressure ($P_P$) on a column of the water-containing liquid in the water suction chamber; and to combine the pump pressure ($P_P$) with a hydrostatic pressure ($P_H$) exerted by said water-containing liquid column;

at which injection pressure ($P_I$) only water injection is carried out.

13. The method according to claim 1, wherein the second flow channel is provided with a first check valve that allows throughput only to the disposal formation; and wherein the method also comprises the following steps:

to divide the second flow channel into, respectively:

an upstream water suction chamber that comprises the pressure manipulation region and the first gas column; and a downstream water injection chamber that comprises a second gas column having a gas pressure ($P_4$);

to connect the water suction chamber in a flow-communicating manner with the water injection chamber via a second check valve that allows throughput only to the water injection chamber;

to connect the second gas column in a flow-communicating and adjustable manner with at least one external, second gas source;

when the water-containing liquid fills the water injection chamber to an upper water level, to direct overpressured gas into the water injection chamber and force the water-containing liquid down to a lower water level in the water injection chamber, whereby the water-containing liquid is injected into the disposal formation; and when the water-containing liquid is located at the lower water level, to shut off the gas inflow and then direct overpressured gas out of the second gas column and thus reduce said gas pressure ($P_4$) until the second check valve opens so as to allow the water-containing liquid to flow into the water injection chamber again.

14. The method according to claim 13, wherein the water injection chamber is connected with the following devices:

a water level stop device structured to stop outflow of the water-containing liquid to the disposal formation at least when the water-containing liquid is located at the lower water level; and a gas flow control device structured to be able to carry out the following functions:

to register when the water-containing liquid is located at the lower water level and, based on this, to direct overpressured gas out of the second gas column until the water-containing liquid again may flow into the water injection chamber; and to register when the water-containing liquid is located at the upper water level and, based on this, to direct overpressured gas into the water injection chamber.

15. The method according to claim 14, wherein the method also comprises:

to connect the gas flow control device with the water injection chamber; and to provide the gas flow control device with at least one directional control valve for allowing control of the flow of overpressured gas to and from the second gas column in the water injection chamber.

16. An apparatus for separating, in a production well, water from a water- and hydrocarbon-containing production flow emanating from at least one surrounding production formation; and for injecting, in the production well, a resulting water-containing liquid into at least one surrounding disposal formation, whilst a resulting hydrocarbon-containing liquid is produced out of the production well;

wherein the apparatus comprises a first flow channel and a second flow channel, both of which are arranged within the production well;

wherein the first flow channel is structured to connect the production formation in a flow-communicating manner with an upstream side of at least one downhole water separation device;

insofar as the upstream side of the water separation device, when in its operational position, is in contact with said production flow having there a pressure ($P_1$);

wherein the second flow channel is structured to connect the disposal formation in a flow-communicating manner with a downstream side of said downhole water separation device; and wherein the second flow channel is arranged with an internal pressure manipulation region having a pressure ($P_2$), and being in pressure-communication with said downstream side of the water separation device;

insofar as the pressure ($P_2$) in the pressure manipulation region, when in its water suction mode, is adjusted to a pressure that is lower than the pressure ($P_1$) in the production flow, the action of will generate a pressure difference ($P_1$-$P_2$) across the water separation device that will suck separated, water-containing liquid into the second flow channel, whilst hydrocarbons will be retained in the water separation device and form said hydrocarbon-containing liquid; and wherein the water-containing liquid is injected into the disposal formation via the second flow channel, and under the influence of an injection pressure ($P_I$) that is higher than a total pressure ($P_T$) exerted by the disposal formation against the injection pressure ($P_I$), and which must be overcome to allow the water-containing liquid to be injected, wherein the second flow channel is adjustably connected with at least one external, first gas source;

wherein the second flow channel is provided with a first gas column having a gas pressure ($P_3$), the first gas column being formed by means of gas from the first gas source;

wherein first gas column is connected in a pressure-communicating manner with the pressure manipulation region, whereby the gas pressure ($P_3$) in the first gas column is arranged to correspond with the pressure ($P_2$) in the pressure manipulation region; and wherein the first gas column is connected to a pressure control device for adjusting the gas pressure ($P_3$) in the first gas column, whereby the pressure ($P_2$) in the pressure manipulation region also is adjusted correspondingly.

17. The apparatus according to claim 16, wherein the water separation device comprises at least one hydrophilic and water-permeable material through which water from the production flow is sucked into the second flow channel due to said pressure difference ($P_1$-$P_2$), whilst hydrocarbons are retained at the upstream side of the water-permeable material.

18. The apparatus according to claim 16, wherein the first gas column is connected with the first flow channel via a gas-filled channel; and wherein the gas-filled channel is connected with the first flow channel at a shallower level where said hydrocarbon-containing liquid has a pressure ($P_5$) that is lower than the pressure ($P_2$) in the internal pressure manipulation region in the second flow channel.

19. The apparatus according to claim 16, wherein the second flow channel is provided with a first check valve that allows throughput only to the disposal formation; and wherein said injection pressure ($P_I$) has been provided by means of:

having the pressure ($P_2$) in the pressure manipulation region increased, through adjustment of said gas pressure ($P_3$), to a pressure that is higher than the pressure ($P_1$) in the production flow, whereby the pressure manipulation region is in water injection mode; and by means of:

having the increased pressure ($P_2$) combined with a hydrostatic pressure ($P_H$) exerted by a column of the water-containing liquid extending down to the disposal formation;

at which injection pressure ($P_I$) only water separation, and no water injection, is carried out.

20. The apparatus according to claim 16, wherein the second flow channel is provided with a first check valve that allows throughput only to the disposal formation;

wherein the second flow channel also is divided into, respectively:

an upstream water suction chamber that comprises the pressure manipulation region and the first gas column; and a downstream water injection chamber that comprises a second gas column having a gas pressure ($P_4$);

wherein the water suction chamber is connected in a flow-communicating manner with the water injection chamber via a second check valve that allows throughput only to the water injection chamber; and wherein the second gas column is connected in a flow-communicating and adjustable manner with at least one external, second gas source;

insofar as overpressured gas is directed into the water injection chamber when the water-containing liquid has filled the water injection chamber to an upper water level, whereby the water-containing liquid is forced down to a lower water level in the water injection chamber and is injected into the disposal formation;

whilst the gas inflow is closed off when the water-containing liquid is located at the lower water level, after which overpressured gas is directed out of the second gas column, whereby said gas pressure ($P_4$) is reduced, until the second check valve is opened so as to allow the water-containing liquid to flow into the water injection chamber again.

* * * * *